US011794941B2

(12) United States Patent
Zamir et al.

(10) Patent No.: US 11,794,941 B2
(45) Date of Patent: Oct. 24, 2023

(54) PLANT ITEM PACKAGING

(71) Applicant: Nalto Marketing Ltd., Ganei Am (IL)

(72) Inventors: Amnon Zamir, Haifa (IL); John Kowarsky, Ganei Am (IL)

(73) Assignee: Nalto Marketing Ltd., Moshav Ganei Am (IL)

( * ) Notice: Subject to any disclaimer, the term of this patent is extended or adjusted under 35 U.S.C. 154(b) by 228 days.

(21) Appl. No.: 16/782,254

(22) Filed: Feb. 5, 2020

(65) Prior Publication Data

US 2020/0247574 A1 Aug. 6, 2020

Related U.S. Application Data

(60) Provisional application No. 62/930,026, filed on Nov. 4, 2019, provisional application No. 62/801,753, filed on Feb. 6, 2019.

(51) Int. Cl.

| | |
|---|---|
| ***B65D 5/00*** | (2006.01) |
| ***B65D 85/50*** | (2006.01) |
| ***B65D 21/02*** | (2006.01) |
| ***B65D 5/20*** | (2006.01) |

(52) U.S. Cl.

CPC ..... *B65D 5/003* (2013.01); *B65D 5/2052* (2013.01); *B65D 21/0201* (2013.01); *B65D 21/0212* (2013.01); *B65D 85/505* (2013.01)

(58) Field of Classification Search

CPC .. B65D 5/003; B65D 5/2052; B65D 21/0201; B65D 21/0212; B65D 85/505; B65D 2571/00209; B65D 2571/0024; B65D 2571/0066; B65D 2571/00716; B65D 5/0005; B65D 5/029; B65D 5/427; B65D 5/4295; B65D 5/5035; B65D 71/14; B65D 81/2084; B65D 85/52

See application file for complete search history.

(56) References Cited

U.S. PATENT DOCUMENTS

| | | | | |
|---|---|---|---|---|
| 3,424,334 | A * | 1/1969 | Goltz | B65D 21/0202 220/23.6 |
| 3,899,121 | A * | 8/1975 | Herbetko | B65D 5/22 229/179 |
| 4,127,228 | A * | 11/1978 | Hall | B65D 5/68 206/521.1 |
| 5,263,612 | A * | 11/1993 | Nederveld | B65D 5/008 229/113 |
| 5,839,651 | A * | 11/1998 | Teags | B65D 5/68 229/125.32 |
| 6,676,010 | B1 * | 1/2004 | Roseth | B65D 5/6664 229/148 |
| 7,441,694 | B2 * | 10/2008 | Kenny | B65D 5/003 229/174 |
| 8,960,469 | B1 * | 2/2015 | Helal | B65B 5/04 206/508 |

(Continued)

*Primary Examiner* — Ernesto A Grano
*Assistant Examiner* — Symren K Sanghera
(74) *Attorney, Agent, or Firm* — Dekel Patent Ltd.; David Klein

(57) ABSTRACT

A packaging assembly includes a packaging enclosure with a bottom closure that folds into a flap with a latch that locks into an opening on a face of the packaging enclosure. Upper faces of the packaging enclosure allow for juxtaposing and superposing a plurality of the packaging enclosures and providing space for air to circulate between them.

4 Claims, 19 Drawing Sheets

(56) References Cited

U.S. PATENT DOCUMENTS

| | | | | |
|---|---|---|---|---|
| 2003/0098256 | A1* | 5/2003 | Lu | B65D 11/1833 229/122 |
| 2003/0146272 | A1* | 8/2003 | Kent | B65D 21/0235 206/509 |
| 2010/0170897 | A1* | 7/2010 | Gold | B65D 21/0204 220/780 |
| 2011/0139648 | A1* | 6/2011 | Sonnenberg | B65D 21/0204 53/452 |
| 2013/0075392 | A1* | 3/2013 | Learn | B65D 5/5286 220/6 |
| 2014/0061289 | A1* | 3/2014 | McKenna | B65D 5/0055 229/174 |
| 2015/0291307 | A1* | 10/2015 | Bourdin | B65D 5/001 229/161 |
| 2016/0107790 | A1* | 4/2016 | Maddox, Jr. | B65D 5/0227 229/103.2 |
| 2017/0166347 | A1* | 6/2017 | Couture | B31B 50/60 |
| 2017/0341801 | A1* | 11/2017 | Carman | B65D 5/4295 |
| 2019/0256241 | A1* | 8/2019 | Exner | B65D 5/003 |
| 2020/0180814 | A1* | 6/2020 | Timpson | B65D 5/243 |

* cited by examiner

PLANT ITEM PACKAGING

FIELD OF THE INVENTION

The present invention relates to packaging, in particular but not limited to, packaging for plant items, such as fresh herbs, cut flowers and the like.

BACKGROUND OF THE INVENTION

The main purpose of corrugated cardboard boxes in agriculture is to move fresh products (such as flowers, vegetables and fresh herbs) from production centers situated in low labor costs countries or areas more naturally favorable for growing these products, to major consuming world markets.

These cartons are packed in the place of origin (such as Africa or South America), stacked on pallets and freighted by air, sea or land transportation to distribution centers or buyers in Europe, USA or Japan.

In the case of fresh herbs, the different cultivars (such as basil) continue to generate heat after cutting and packing, even under refrigerated conditions. The heat is affecting the quality of the herbs and often causes rejects at arrival.

The regular cartons used to pack one kg or more usually have the shape of a rectangular prism (such as a cube). Due to high cost of air freighting, when packed on a shipping pallet, the boxes are densely laid, leaving no space between them, blocking the circulation of air between the boxes.

In these conditions, only the boxes on the external faces of the pallets benefit from the cool air and block it from reaching the inner boxes on the pallet. The absence of circulation further increases the heating process so that the point of thermal equilibrium cannot be reached uniformly for all the boxes.

Therefore, there is a growing demand for packages that will allow proper and uniform cooling for all the boxes on the pallet.

Commonly this demand is met by either packing less herbs in a box, or using a box with a larger volume for the same 1 kg of herbs. Another solution is omitting several boxes on each layer of boxes on the pallet in such a way that columns are formed across the layers that allow more faces of the boxes to be exposed to cool ambient air.

All these solutions mitigate the heat generation but also reduce the efficiency and result in augmenting costs of packaging materials and shipping.

These costs play a significant part in the general cost of the produce, sometimes reaching up to 30% of the total selling price.

This invention consists of an efficient solution that addresses the heat generation and offers an efficient way to improve the cooling, optimize the shipping space and reduce shipping costs.

This invention is based on contracting the bottom part of the box to form space between the boxes. The space at the bottom part of the box is occupied by the stems. The stems can be safely pressed because they do not produce heat. The spare space is used to create an exhaust like tunnel through which the heat discharges and is replaced with cool air.

BRIEF DESCRIPTION OF THE DRAWINGS

The present invention will be understood and appreciated more fully from the following detailed description taken in conjunction with the appended drawings in which the figures illustrate embodiments of the new packing method according to the present invention.

DESCRIPTION OF THE INVENTION

Illustrative embodiments of the invention are described below. In the interest of clarity, not all features/components of an actual implementation are necessarily described.

It is a particular object of the present invention to provide a packaging method which is especially adapted and advantageous for shipping fresh herbs, such as but not limited to, basil, rosemary, mint or sage and allow better cooling of the packed herbs.

The box is made with foldable material such as cardboard, corrugated board, corrugated PE or similar.

Figure 1:
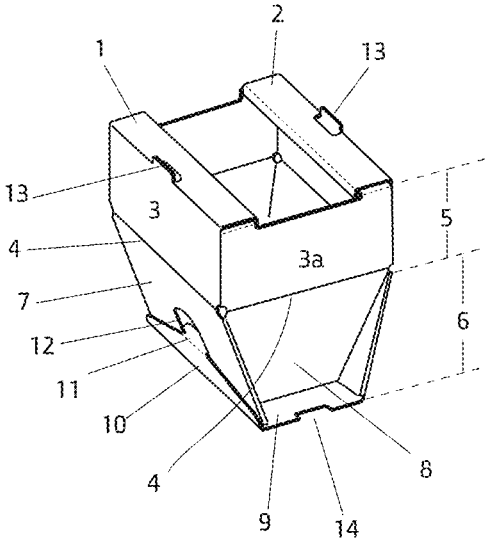
FIG. 1 is a simplified illustration of a plant item packaging in accordance with a non-limiting embodiment of the invention.
Figure 2:
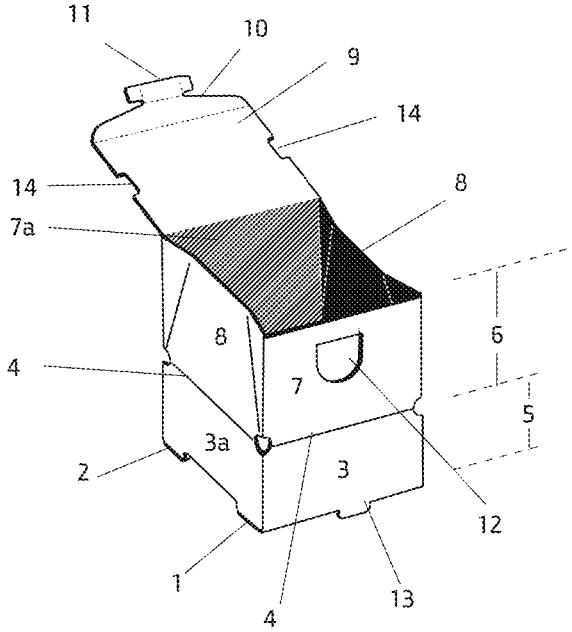
FIG. 2 is a simplified illustration of a plant item packaging with the bottom up and opened.

FIG. 1 shows the box from a top diagonal view. FIG. 2 shows the box with the bottom up and opened. The different parts of the box are described with the same number on both these drawings.

The box has two top shoulders 1 and 2, each having a lock 13. Crease lines 4 divide the box in an upper part 5 and lower part 6. Part 5 consists of two parallel walls 3 and two parallel walls 3*a*. Lower part 6 consists of two flat walls 7 and 7*a* opposed to each other and two walls 8 and 8*a*, each divided into three facets.

The box has a bottom closure 9 that folds into a flap 10 equipped with a lock 11 that locks into opening 12 on face 7. The bottom closure 9 has two notches 14 that fit on locks 13 when the boxes are superposed.

Figure 3:
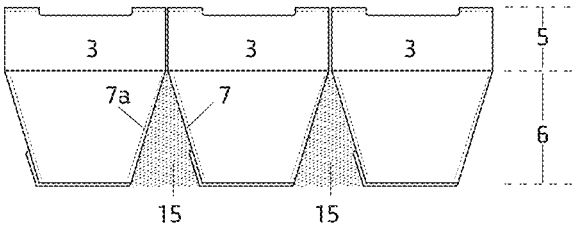
FIG. 3 is a simplified illustration of several such packaging boxes placed one next to the other.

FIG. 3 shows several boxes placed one next to the other. Upper faces of the box 3 allow for juxtaposing the boxes and tie them securely as they would be if they were plain rectangular boxes. When juxtaposed, slanted lower faces 7 and 7*a* form a triangular space 15 between every pair of boxes, through which air can circulate freely.

Figure 4:
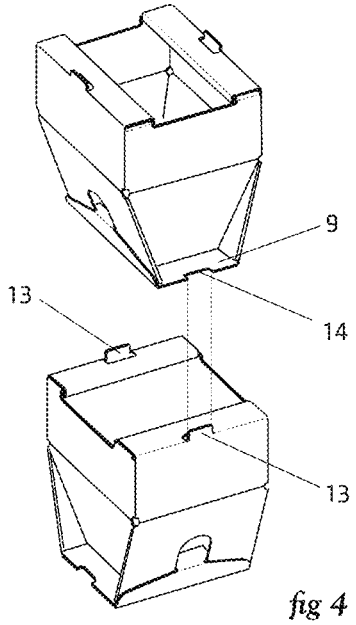
FIG. 4 is a simplified illustration of the packaging boxes superposed with each other.

FIG. 4 shows how the boxes are superposed. To superpose two boxes, the upper box is rotated 90° around its bottom closure 9 in a way that locks 13 on the bottom box fit into the notches 14 on the bottom closure 9 of the upper box.

Figure 5:
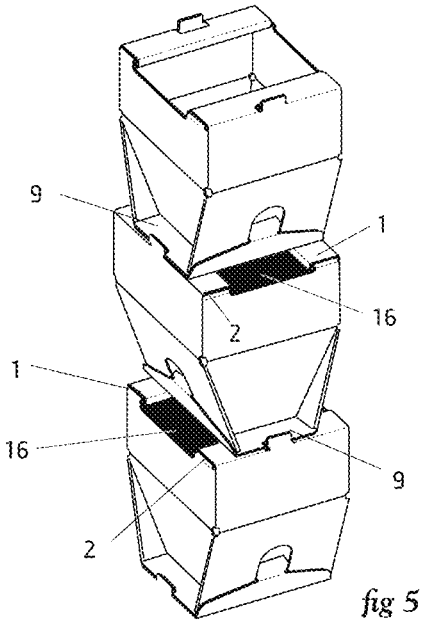
FIG. 5 is a simplified illustration of several of the packaging boxes superposed with each other.

FIG. 5 shows several said boxes superposed. The bottom closures 9 are supported by the shoulders 1 and 2, leaving openings 16 on both sides of the base. In this arrangement, the box on top does not obstruct the top of the box underneath. This way, the heat can discharge from each and every box evenly into the airways 17 described in FIG. 6.

Figure 6:
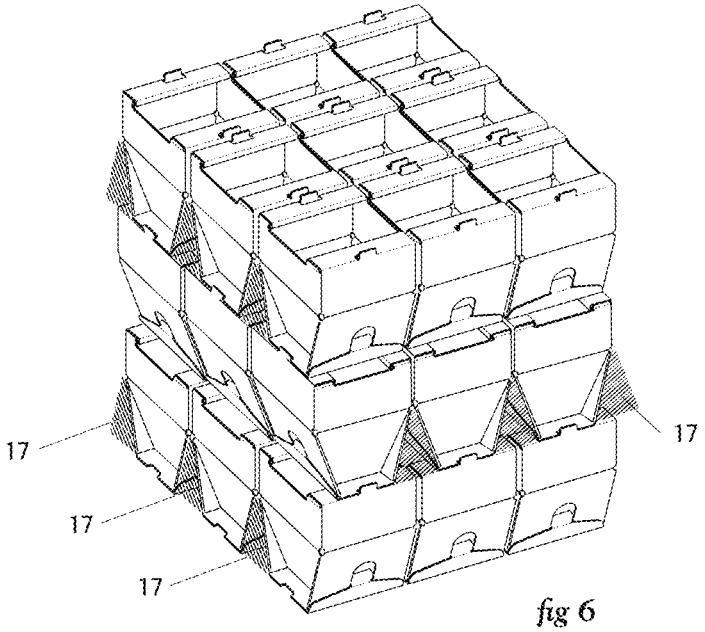
FIG. 6 is a simplified illustration of a stack of the packaging boxes.

FIG. 6 shows how a plurality of said boxes is stacked. On each layer, the boxes are rotated 90° in relation to the box below as described in FIG. 5. In this arrangement of the boxes, triangular tunnels 17 are formed between the rows right above the openings 16 on the top of the boxes. When filled as will be described shortly, the heat generated by the herbs will be discharged through the tunnels and be replaced by cold air.

Figure 7:
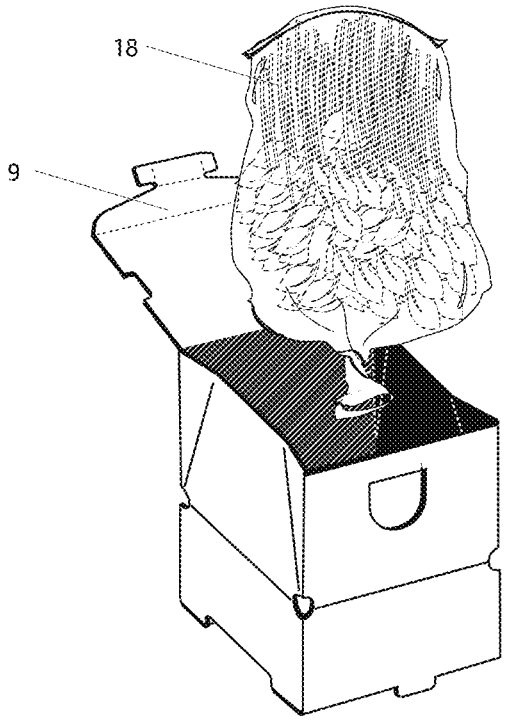
FIG. 7 is a simplified illustration of cultivars which must be shipped vertically with leaves facing up.

FIG. 7 shows an embodiment, for example, for packing fresh herbs. The box is laid bottom-up with the bottom closure 9 open as shown.

The herbs, usually contained in a modified atmosphere package bag 18 are inserted with their stems side up into the box. This is important as some of the cultivars are geotropic and must be shipped vertically with the leaves facing up, as seen in FIG. 7. After closing, the box will be turned up and the leaves will be facing up.

Figure 8:
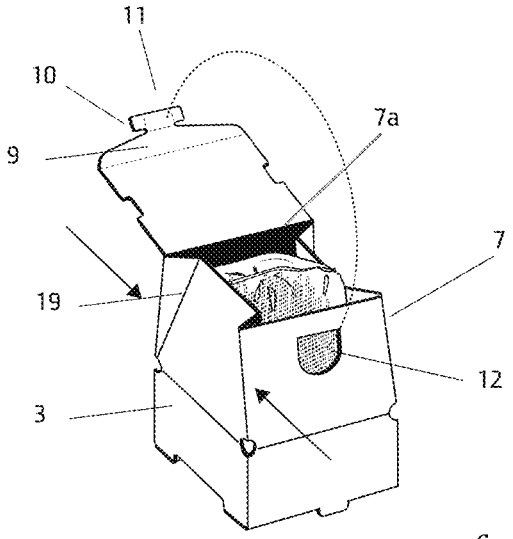
FIG. 8 is a simplified illustration of closing the box of FIG. 7.

FIG. 8 shows how to close the box. To close the box, slight pressure is applied on both faces 7 and 7*a* inward as shown by the arrows.

Bottom closure 9 is then closed and locked in place by pushing the lock 11 into the opening 12. Since the length of the bottom closure 9 is shorter than the length of the face 3, a contraction occurs along the two diagonal creases 19 on face 8 which forces the faces 7 and 7*a* into an angled position. The box is now closed and turned upside down and placed on the pallet as described in FIG. 6.

Figure 9:
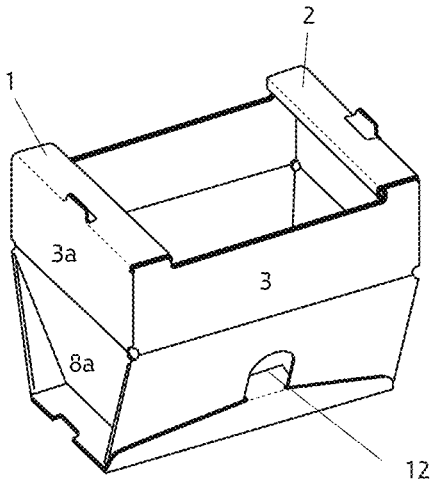
FIG. 9 is a simplified illustration of a version of the box which does not need rotation when superposed.

FIG. 9 shows another embodiment of the invention. It consists of moving the shoulders 1 and 2 to be perpendicular to face 3 instead of 3*a*. In other words: instead of being an extension of the face of the lock 11, they will be on the same sides as the tri-folding faces 8 and 8*a*. This enables superposition of boxes without the 90° rotation and can be used with rectangular boxes. All other assets explained so far are maintained.

Figure 10:
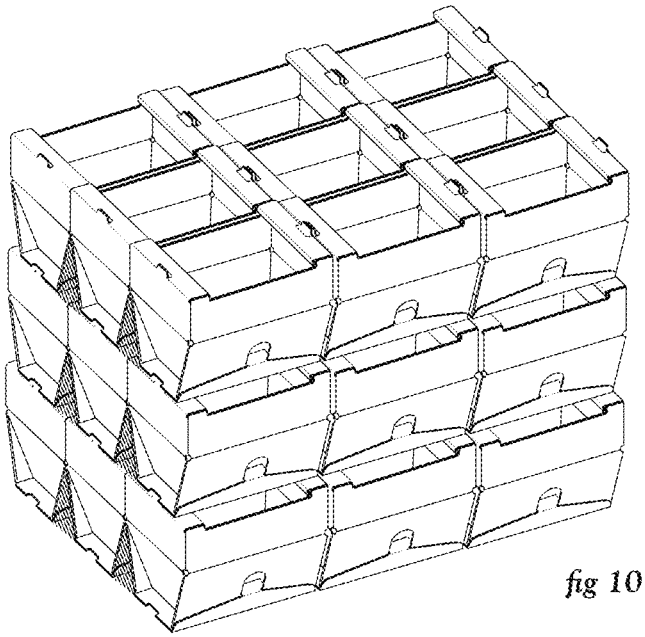
FIG. 10 is a simplified illustration of stacking for the version of the box which does not need rotation when superposed.

FIG. 10 shows a plurality of the version of the box. The triangular tunnels are maintained, but only in one direction.

A prior art practice of bundling boxes is by using a lateral strap to keep several boxes together. In this method, most of the tension of this strap is concentrated at the four corners of the bundle. Any other box within such a bundle is kept in place with the pressure applied by the adjacent boxes in the bundle. This condition is usually not reliable and often results in boxes slipping when the bundles are moved, for example to build a layered skid. This method is also limited to a small number of boxes.

Instead of using a strap, the boxes can be packed in a master carton but this further increases the heating problem, adds to the cost of packaging, airfreighting and volume.

Figure 11:
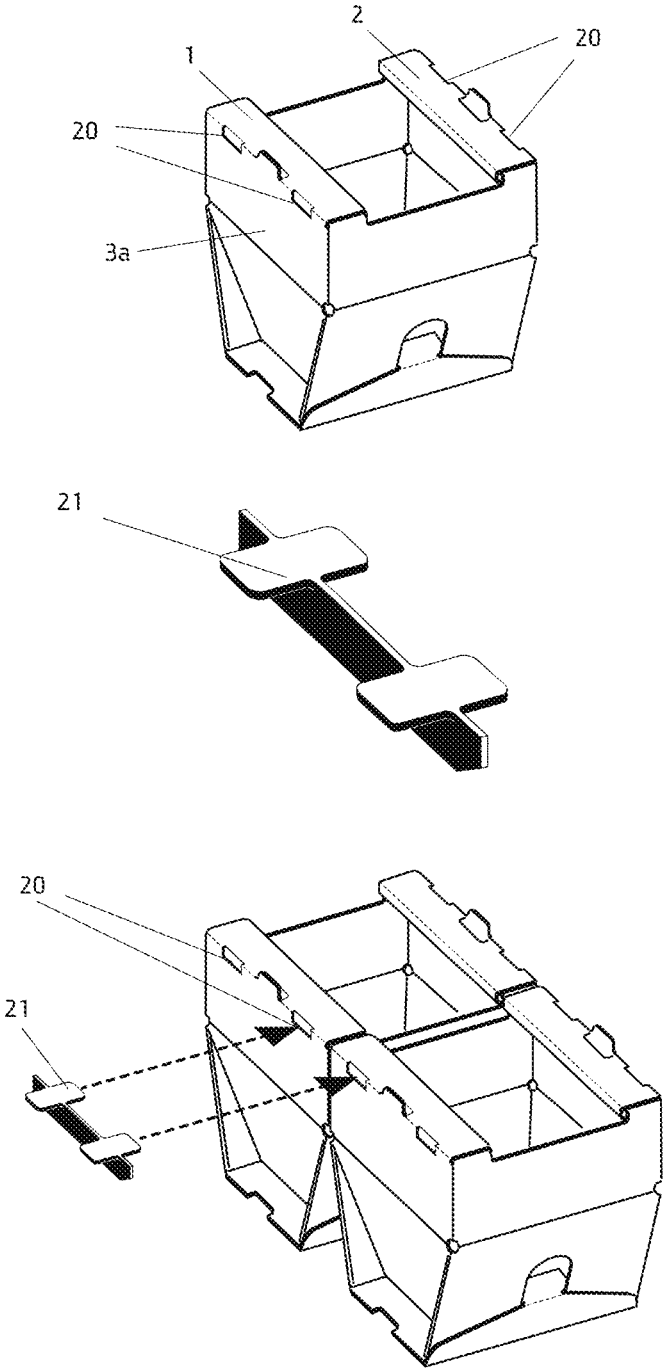
FIG. 11 is a simplified illustration of a method for making bundles of multiple boxes based on the invention.

FIG. 11 shows a method for making bundles of multiple boxes based on the invention. This method solves these prior art problems of bundling and packing in master cartons.

The box has on both faces 3*a* two notches 20 in which the flaps forming the shoulders 1 and 2 snap into and lock. A connector made of plastic or any other rigid material having a general shape such as the one shown 21, is inserted in the notches 20 of two adjacent boxes as indicated by the arrows. The connector now connects two boxes along one continuous edge.

Figure 12:
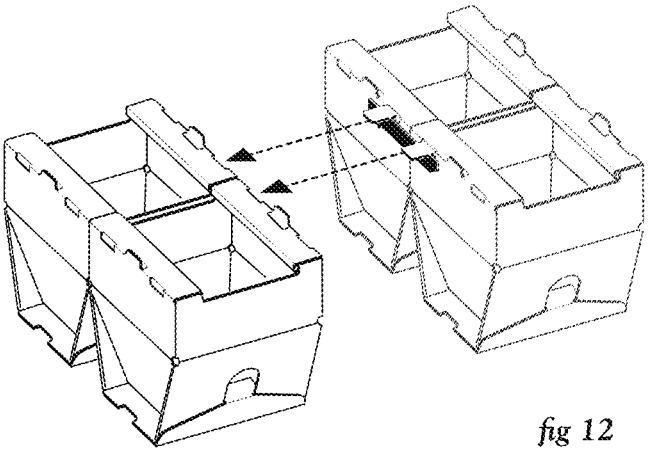
FIG. 12 is a simplified illustration of repeating the procedure of FIG. 11 to add more boxes to the group.

FIG. 12 shows how this procedure is repeated to add two more boxes to the group.

Figure 13:
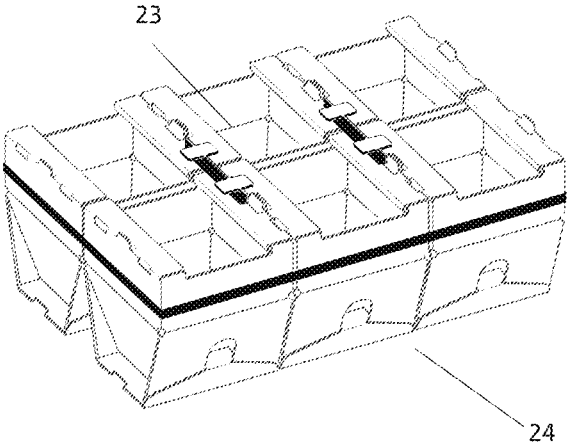
FIG. 13 is a simplified illustration of a bundle of six boxes formed using the method of FIG. 11.

FIG. 13 shows how a bundle of six boxes is formed using this method: two connectors 21 are used to group six boxes as shown. The bundle is completed by strapping around the six boxes. As a result of using this method, the two boxes at the center 23 and 24 will not detach from the bundle since they are held together with the corner boxes.

Figure 14:
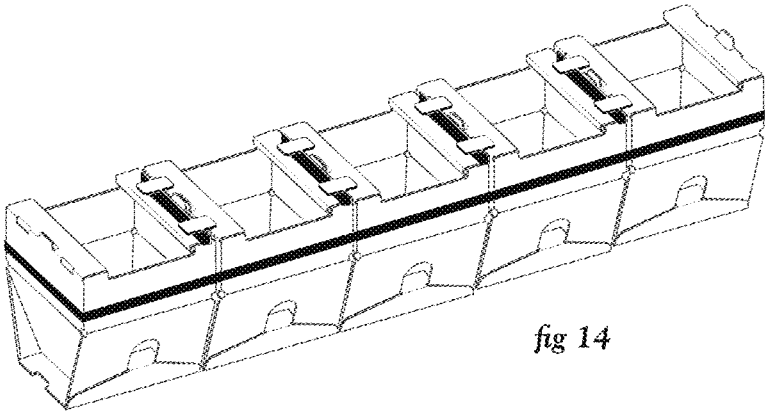
FIG. 14 is a simplified illustration of bundling of any desired number of boxes in even or odd quantities.

FIG. 14 shows how this method allows bundling of any desired number of boxes in even or odd quantities and can be adjusted to any optimization of different sizes of boxes and pallets. This method conserves all the properties previously described.

Figure 15:
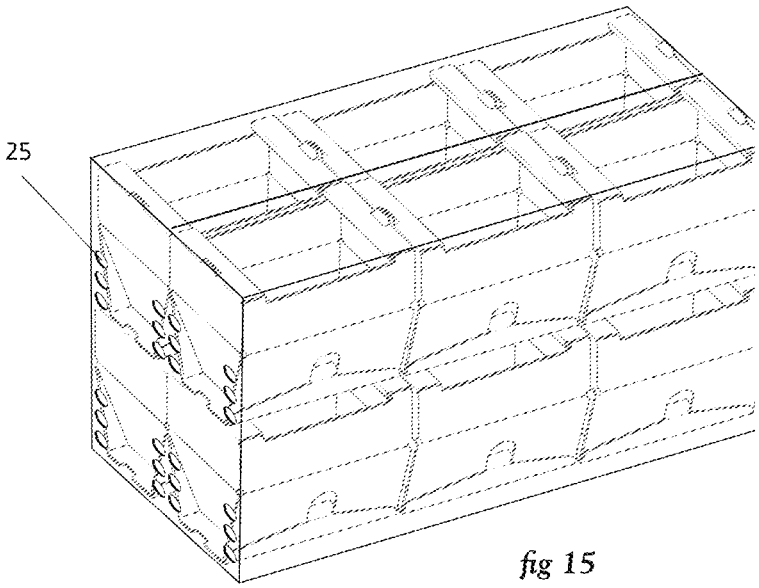
FIG. 15 is a simplified illustration of another method of bundling with a master carton.

FIG. 15 shows another method of bundling, with a master carton which is sometimes required by end-users. To ensure the properties of the boxes and allow for circulation of air in the airways formed between them, as shown in FIG. 10, the master cartons are equipped with apertures 25, situated at both extremities of the airways. This design is adapted to different types of master cartons, whether they are closed or not on all sides or designed to partly fit the boxes they contain.

Figure 16:
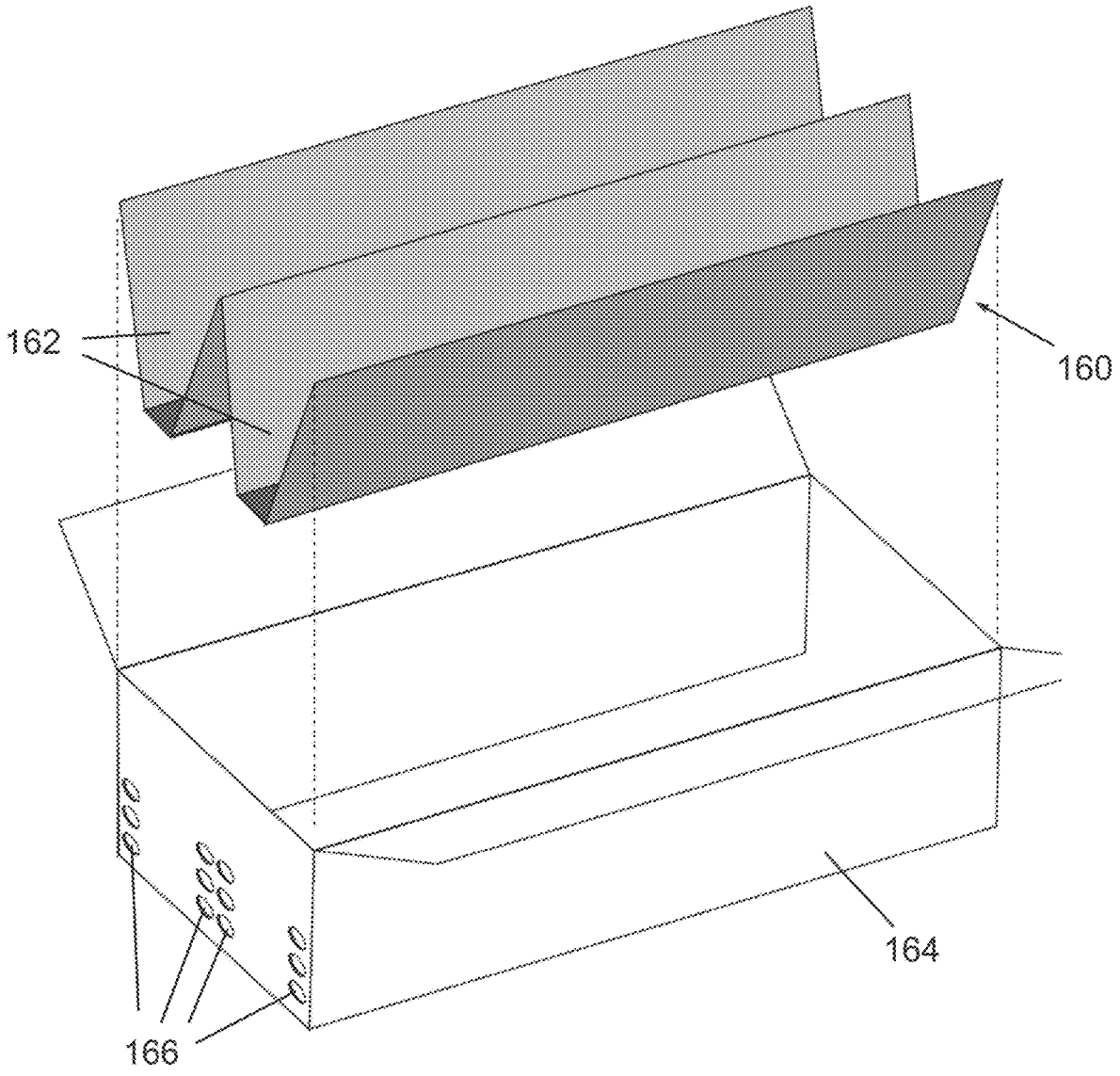
FIG. 16 is a simplified illustration of another packaging assembly of another embodiment of the invention, having airflow passageways.

FIG. 16 shows another packaging assembly of another embodiment of the invention. In this packaging assembly, an insert 160 is folded or otherwise formed with longitudinal troughs 162 and is placed in a box 164 that has apertures 166. Air can flow through apertures 166 and troughs 162, thereby providing airflow passageways for cooling the produce.

Figure 17:
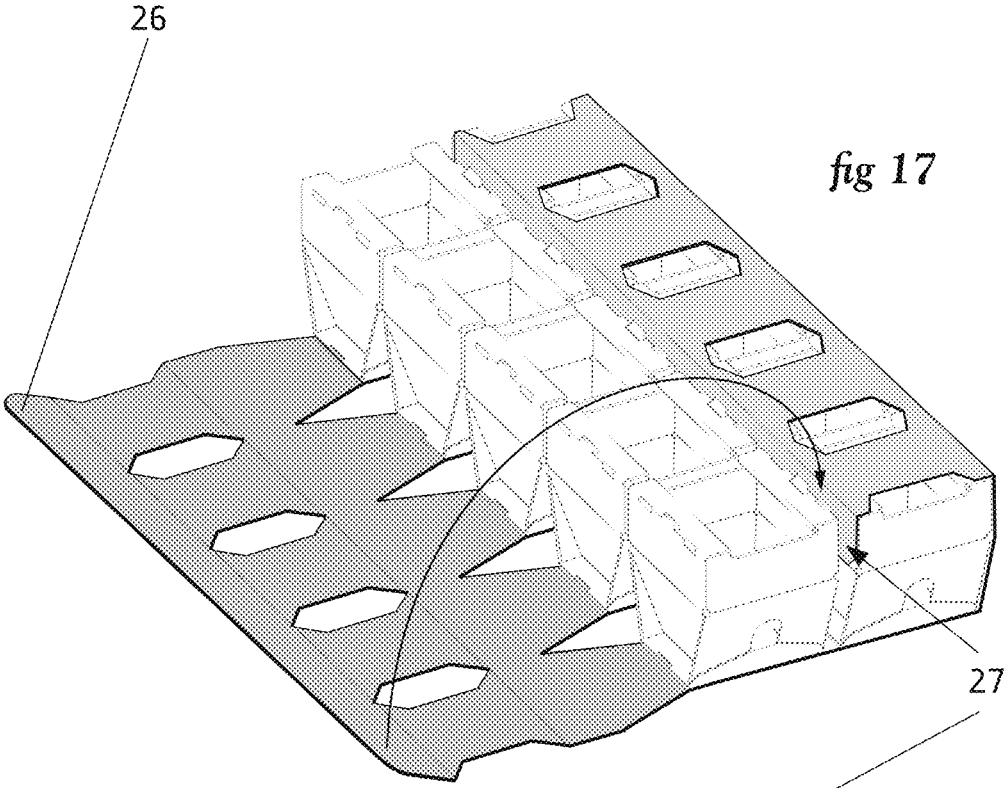
FIG. 17 is a simplified illustration of another method of bundling, with a master carton, in accordance with an embodiment of the invention.

FIG. 17 shows another method of bundling, with a master carton. This method works in conjunction with the specific air vents created by the specific properties of the box described so far.

The master carton bundles several pairs of boxes, typically, but not necessarily, ten, as shown in FIG. 17. The master carton is equipped with openings in the respective shapes and emplacements to fit the openings of the air ducts 17 of FIG. 6.

Figure 18:
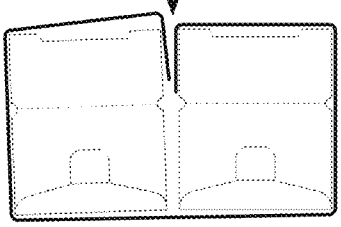
FIG. 18 is an end-view illustration of the master carton bundles.

The master carton may be placed flat on a working surface. The boxes may be placed at the center of the carton and the flap 26 may be folded toward the center space between the two lines of boxes 27, as shown in FIG. 17. FIG. 18 shows an end-view of the master carton bundles.

Figure 19:
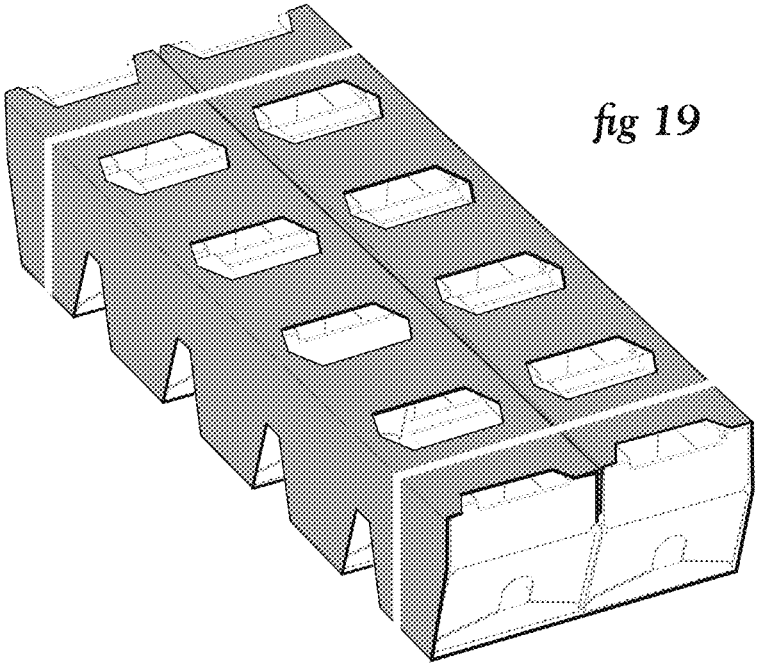
FIG. 19 is a simplified illustration of the finishing stage of the master carton bundles.

FIG. 19 shows the finishing stage. The master carton is strapped with one or more straps or adhesive tape and can be palletized while conserving all the properties of the box and the stacking methods described previously for any other embodiments. Another particular property of this master carton bundle is that it can be adapted to 2, 4, 6, or 8 or any other number of boxes by cutting or producing a specific master.

In addition, the same concept can be used to pack two or more layers and can be adapted to a plurality of combinations.

Figure 20:
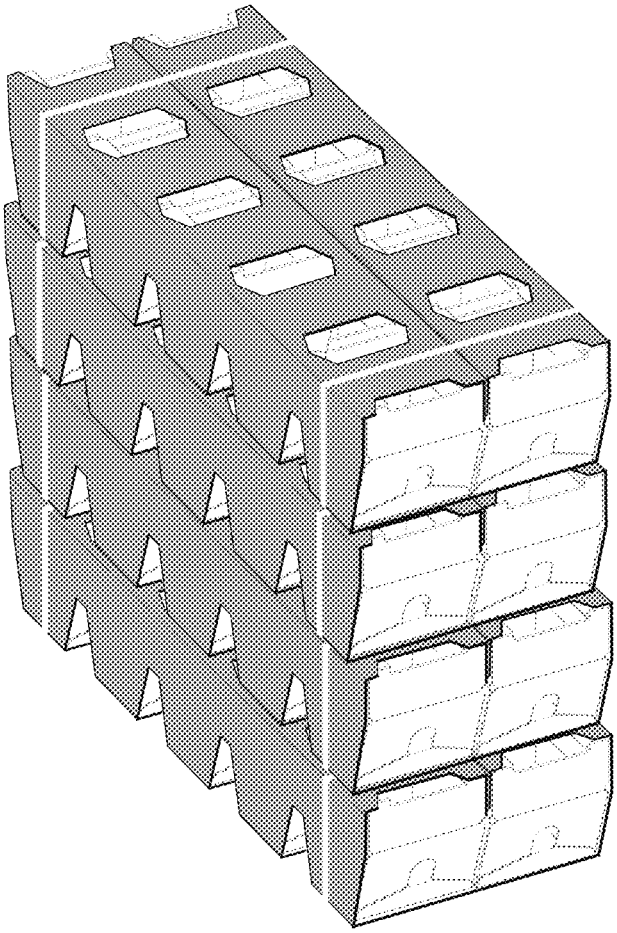
FIG. 20 is a simplified illustration of how the master bundles are stacked.

FIG. 20 shows how the master bundles are stacked.

What is claimed is:

1. A packaging assembly comprising:

a plurality of boxes, each of said boxes comprising an upper part and a lower part, said upper part comprising four vertical sides made of two pairs of flat panels that are parallel to each other, and two horizontal shoulders extending from upper edges of the four vertical sides, each of said horizontal shoulders having a length extending between short edges of said horizontal should and a width extending between inner and out long edges of said horizontal shoulder, wherein for each of said horizontal shoulders, said outer long edge extends from one of the upper edges of the four vertical sides and an inner vertical face extends vertically downwards from said inner long edge, and said upper part is open between said inner vertical faces of said horizontal shoulders and between upper edges of the pair of flat panels that are along said short edges of said horizontal shoulders, wherein each of the vertical sides that is perpendicular to said inner vertical faces comprises two upper shoulder-abutting edges coupled to the width of said horizontal shoulder and an intermediate upper edge which is vertically lower than said upper shoulder-abutting edges;

wherein a tab protrudes upwards from each of said horizontal shoulders, said tab being positioned along the outer long edge of said horizontal shoulder; and wherein said lower part comprises four sides, each of which extends from a lower edge of one of said vertical sides, each of said four sides of said lower part being slanted inwards from an upper edge to a lower edge thereof, and wherein on the side of the box that has the intermediate upper edge, a horizontal flap extends outwards from the lower edge of said side of said lower part and a notch is formed in said horizontal flap;

wherein when an upper one of said boxes is stacked on a lower one of said boxes, said tabs of said lower one of said boxes are received in said notches of said upper one of said boxes.

2. The packaging assembly according to claim 1, wherein for each of said boxes, crease lines are formed between said upper and lower parts.

3. The packaging assembly according to claim 1, wherein when the upper one of said boxes is stacked on the lower one of said boxes, portions of said upper part of the lower one of said boxes remain open.

4. The packaging assembly according to claim 1, wherein when said boxes are placed next to and abutting each other, a triangular space is between said lower parts of said boxes through which air can circulate freely.

* * * * *